US006960116B2

(12) United States Patent
McNeil et al.

(10) Patent No.: US 6,960,116 B2
(45) Date of Patent: Nov. 1, 2005

(54) WHEEL POLISHING DEVICE

(75) Inventors: Gary McNeil, Allegan, MI (US); Jeremy Hammond, Portage, MI (US)

(73) Assignee: Roto-Finish Company, Inc., Kalamazoo, MI (US)

( * ) Notice: Subject to any disclaimer, the term of this patent is extended or adjusted under 35 U.S.C. 154(b) by 0 days.

(21) Appl. No.: 10/784,133

(22) Filed: Feb. 20, 2004

(65) Prior Publication Data

US 2005/0186889 A1 Aug. 25, 2005

(51) Int. Cl.[7] ..... B24C 1/08
(52) U.S. Cl. ..... 451/36; 451/113; 451/104
(58) Field of Search ..... 451/36, 104–106, 451/113, 60, 80, 82, 330

(56) References Cited

U.S. PATENT DOCUMENTS

| | | | | |
|---|---|---|---|---|
| 695,986 | A | 3/1902 | Wilson | |
| 749,622 | A | 1/1904 | Long | |
| 834,249 | A | 10/1906 | Beardslee | |
| 1,811,204 | A | 6/1931 | Laughlin | |
| 4,173,851 | A | 11/1979 | Higashi | |
| 4,581,853 | A | 4/1986 | Marcus | |
| 4,615,145 | A | 10/1986 | Matsumoto et al. | |
| 4,689,921 | A * | 9/1987 | Murate et al. | 451/36 |
| 4,706,414 | A | 11/1987 | Muzik | |
| 4,763,392 | A | 8/1988 | Fogal et al. | |
| 4,950,505 | A | 8/1990 | Fogal | |
| 5,088,238 | A | 2/1992 | Lin | |
| 5,593,339 | A * | 1/1997 | Yam et al. | 451/36 |
| 5,653,247 | A | 8/1997 | Murakami | |
| 5,857,901 | A | 1/1999 | LaPoint | |
| 6,280,303 | B1 | 8/2001 | Kawasaki | |
| 6,406,356 | B1 | 6/2002 | Brooks | |
| 6,719,611 | B2 * | 4/2004 | Kordonski et al. | 451/36 |
| 2005/0072733 | A1 * | 4/2005 | Consolini et al. | 210/634 |

* cited by examiner

*Primary Examiner*—Lee D Wilson
(74) *Attorney, Agent, or Firm*—Flynn, Thiel, Boutell & Tanis, P.C.

(57) ABSTRACT

A device for finishing workpieces, such as automobile wheels. The device includes a bowl assembly containing polishing media therein, and a drive assembly including a rotatable turret which carries the wheels thereon so that same are orbitally driven through the polishing media. A cam arrangement is provided which essentially continuously adjusts the angle of the wheels relative to the polishing media by pivoting the wheels about respective vertical axes. The device is additionally provided with a vertical drive assembly which allows vertical oscillation of the wheels relative to the media, and the polishing device also permits adjustment of the pitch or rake angle of the wheels relative to the horizontal.

17 Claims, 16 Drawing Sheets

WHEEL POLISHING DEVICE

FIELD OF THE INVENTION

This invention generally relates to devices for finishing workpieces such as machined metal parts and, more particularly, to devices for finishing automobile wheels.

BACKGROUND OF THE INVENTION

The popularity of stylized motor vehicle wheels with automobile owners has increased, in particular with luxury and sports cars. Many motor vehicles now include decorative aluminum or steel wheels which require polishing prior to layering with a suitable coating or plating material to produce a glossy or lustrous surface. Typically, chrome or copper is coated on the front face of such wheels to enhance the overall aesthetic appearance of the automobile.

In order to provide wheels with such an aesthetically pleasing appearance, the front face of the wheel must be finished so as to be as smooth as possible prior to coating, since any imperfections in the finish of the wheel face will typically be magnified by the plating material. One method still in use presently is to manually polish or finish the front wheel face by rubbing an abrasive onto same by hand. Finishing wheels in this manner is time consuming, tedious, and expensive.

In view of the inefficiencies associated with finishing wheels by hand, various types of automated machines have been developed for this purpose. For example, U.S. Pat. No. 6,406,356 discloses a wheel finishing apparatus including a rotating carousel-type hub which mounts thereon multiple wheel-carrying arm assemblies. The rotating carousel drives the wheels in an orbit through a tank containing polishing media so that the wheels are partially submerged within the media. Each arm assembly is constructed so as to allow pivotal adjustment of the mounted wheel about a vertical pivot axis parallel with the cental axis of rotation of the carousel hub.

The wheel polishing device according to the present invention includes a drive assembly which is supported on and positioned above a bowl assembly containing polishing media. The drive assembly includes a turret which supports at least one wheel and positions same within the polishing media. The turret is rotatable relative to the bowl assembly such that the wheel or wheels carried thereon is orbitally driven through the polishing media to polish at least the front face of the wheel. The device additionally includes a cam arrangement which causes pivoting of the wheel about a vertical pivot axis at least once per revolution about the bowl. Further, the polishing device also permits adjustment of the angle of the wheel axis relative to the horizontal, and allows vertical oscillation of the wheel within the media.

Many wheels which require polishing include a number of openings inwardly of the wheel rim which extend through the wheel. The pivoting movement of the wheel about its vertical pivot axis, as well as the vertical oscillation of the wheel relative to the media effectively breaks up the flow of media within the bowl or storage tank which can tend to become stagnant during processing, and forces the media into different flow paths through the wheel. Further, varying the position of the wheel in the above manner also reduces the tendency of the media to collect and become stuck or wedged within the openings of the wheel. By adjusting the position of the wheel axis relative to the horizontal, the force of the cutting action of the media on the wheel can be varied based upon the level of polishing which is needed. All of the above measures according to the invention provide better coverage of the media on the wheel, which improves the overall finish and decreases the amount of time required to process the wheel.

The wheel polishing device according to the invention in one embodiment includes a hub arrangement which is located in the center of the tank or bowl containing the polishing media. The hub arrangement serves to restrict the flow of media so that same is compressed against the wheel during processing. Otherwise, media can build up in the center of the bowl during processing, thereby reducing the polishing effect thereof on the wheel. The hub arrangement incorporates a plurality of wings which are adjustable inwardly or outwardly based upon the size of the wheel being processed.

Other objects and purposes of the invention will be apparent to persons familiar with devices of this general type upon reading the following specification and inspecting the accompanying drawings.

Figure 1:
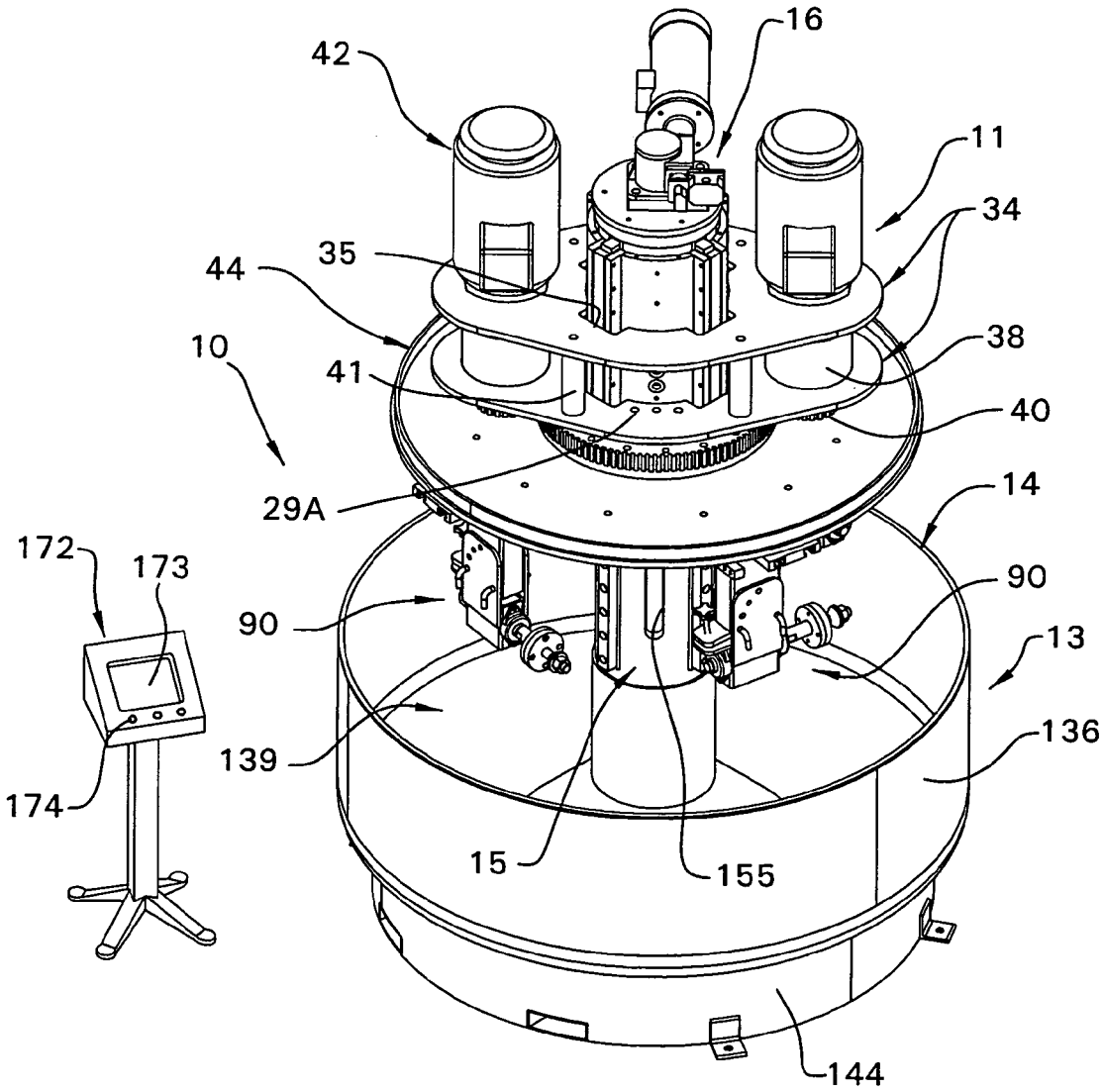
FIG. 1 is a perspective top view of the wheel polishing device according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the device and designated parts thereof. Said terminology will include the words specifically mentioned, derivatives thereof, and words of similar import.

DETAILED DESCRIPTION

Referring to the drawings, there is illustrated a wheel polishing device 10 according to the present invention. The wheel polishing device 10 includes a drive assembly 11 on which a plurality, and here four, of wheels 12 (see FIG. 7) are mountable thereon. The device 10 additionally includes a bowl assembly 13 defined by a bowl or tub 14 containing polishing media 14A therein, and an upright support 15 which projects upwardly from a central region of the bowl 14 and mounts the drive assembly 11 thereon. Polishing device 10 further includes a vertical drive assembly 16 supported at the upper end of upright support 15.

Figure 5:
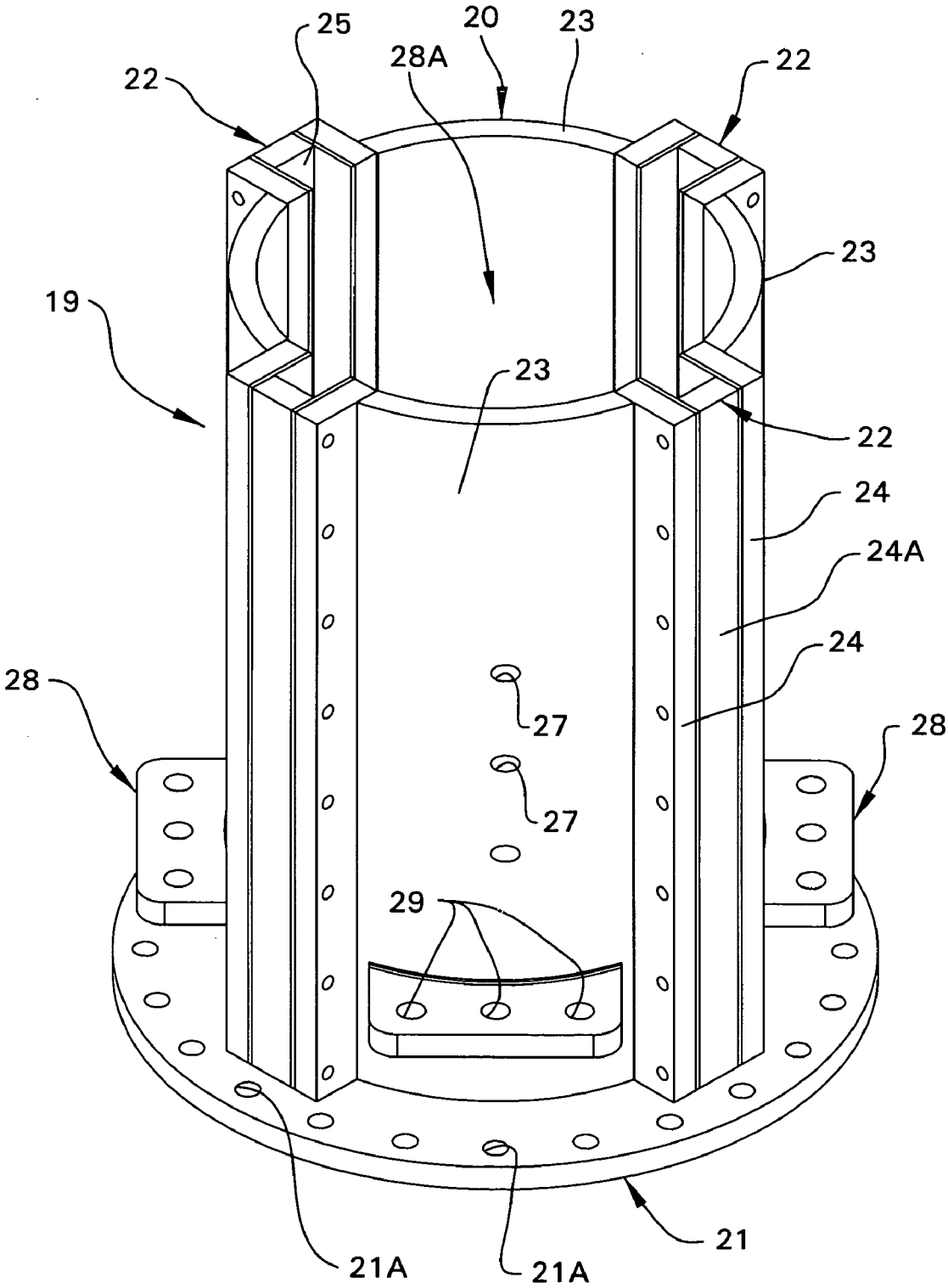
FIG. 5 is an enlarged perspective top view of the mounting sleeve of the drive assembly.
Figure 6:
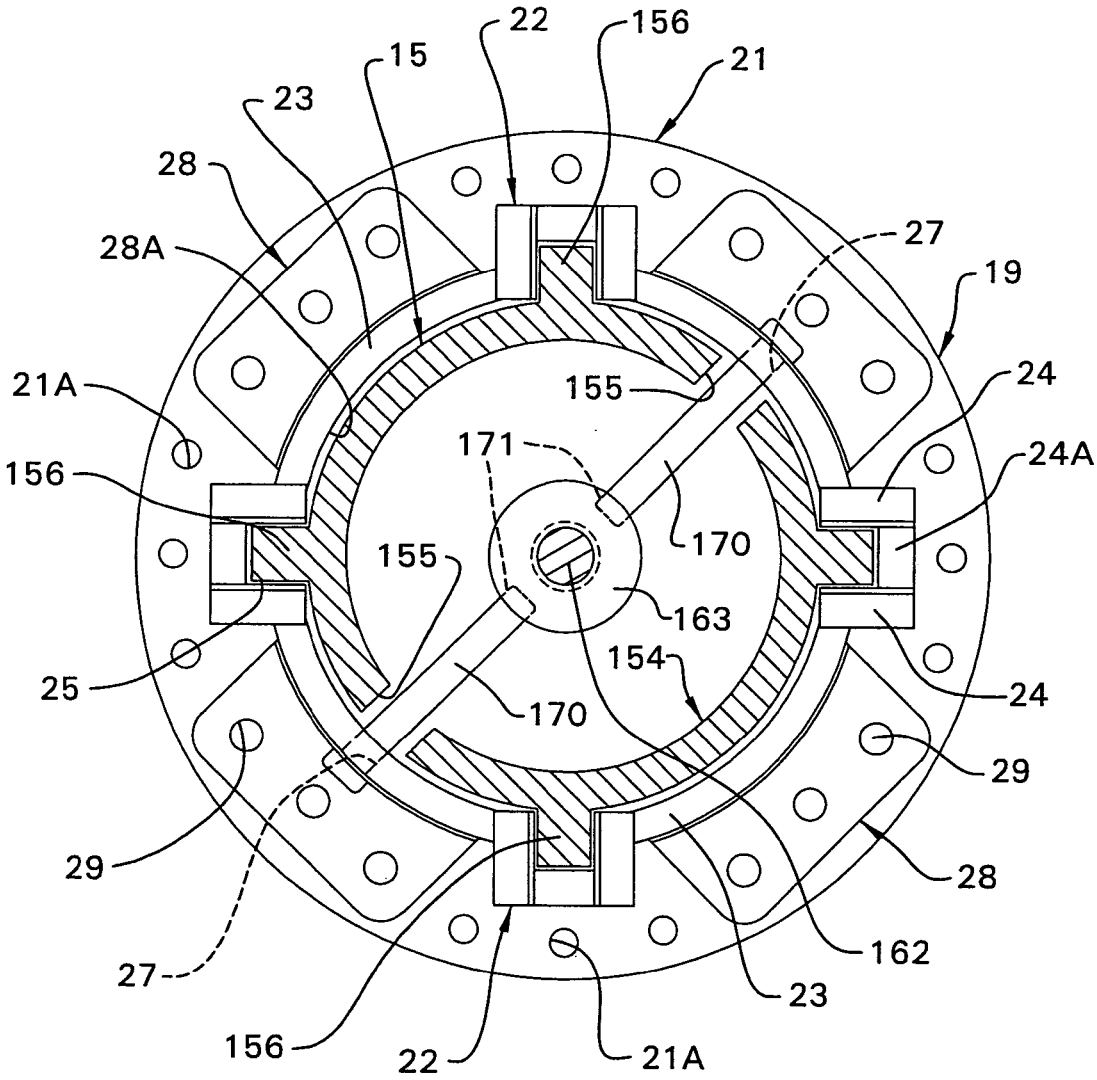
FIG. 6 is an enlarged cross-sectional view taken generally along line 6—6 in FIG. 3.

With reference to FIGS. 5 and 6, the drive assembly 11 includes a mounting sleeve 19 having a generally cylindrical upper part 20 and a lower, ring-like flange 21 fixed to the lower end of upper part 20. Flange 21 projects sidewardly from lower end of upper part 20 and is generally perpendicular thereto. Further, flange 21 defines therein a plurality of openings 21A which extend generally vertically and completely through flange 21. Upper part 20 defines a plurality, and here four, of channel structures 22 which are equally spaced from one another about the circumference of upper part 20. Each pair of adjacent channel structures 22 are interconnected by an arcuate side wall 23, which side walls 23 curve outwardly and together define the cylindrical shape of upper part 20. Each channel structure 22 is defined by a pair of upright and generally parallel side wall parts 24 which are spaced from one another by an outer wall part 24A which extends between and interconnects the respective side wall parts 24. The side and outer wall parts 24 and 24A of each channel structure 22 together define an inwardly opening and generally vertically oriented and elongated channel 25. Two diametrically opposed arcuate side walls 23 of sleeve 19 define therein a plurality, and here three, of openings 27, which openings 27 are arranged in a vertical row located generally centrally between the respective channel structures 22.

Each arcuate side wall 23 mounts thereon a generally horizontally projecting mounting plate or flange 28 adjacent a lower end thereof, which plates 28 are generally parallel with the lower flange 21 and spaced a short distance upwardly therefrom. Each plate 28 defines therein a plurality, and here three, of holes 29 which project vertically and completely through the respective plate 28. As shown in FIGS. 5 and 6, the inner surfaces of the respective arcuate side walls 23 together define an opening 28A which extends completely through the vertical extent of mounting sleeve 19.

Figure 2:
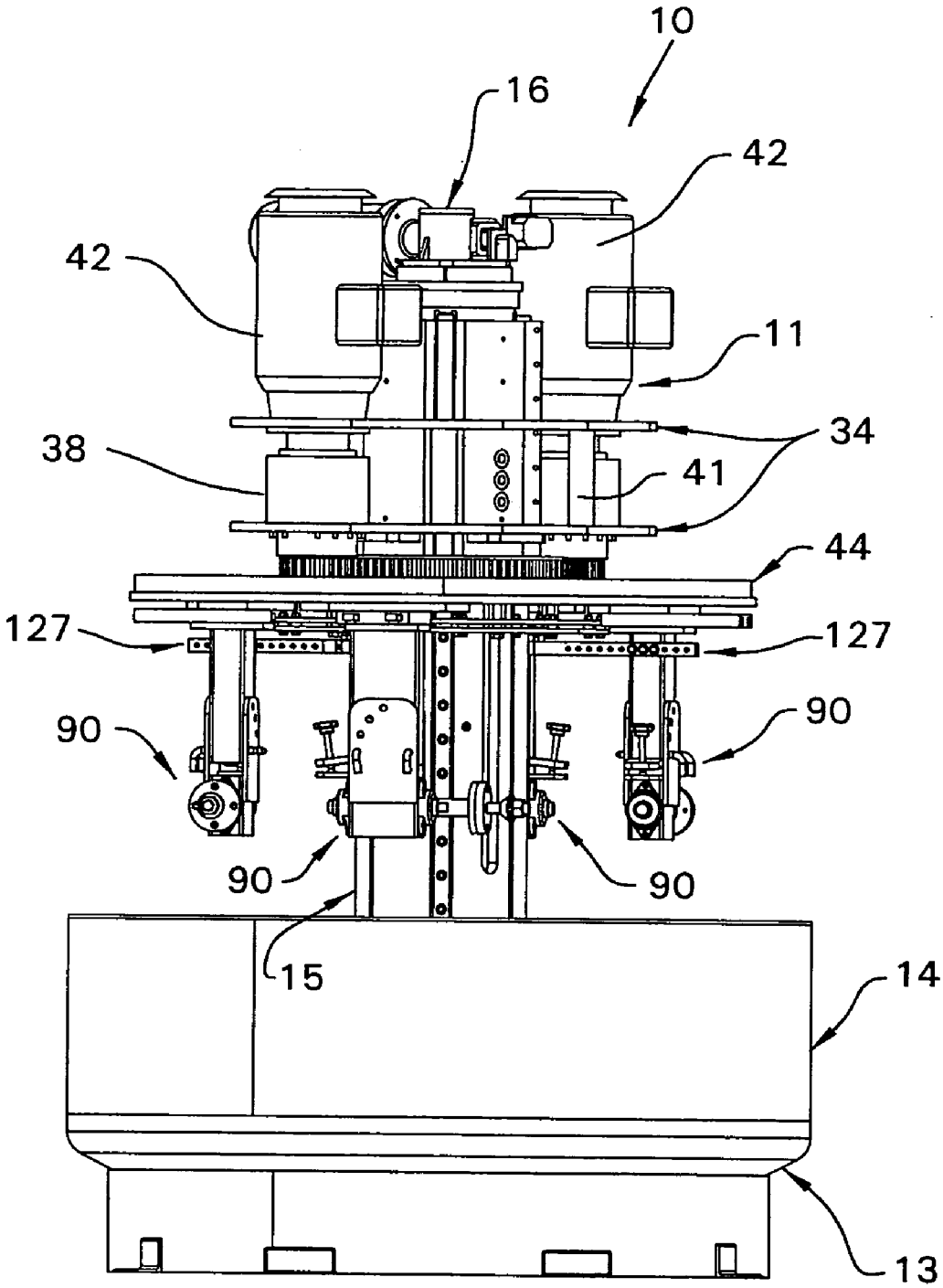
FIG. 2 is a side elevational view of the wheel polishing device.
Figure 3:
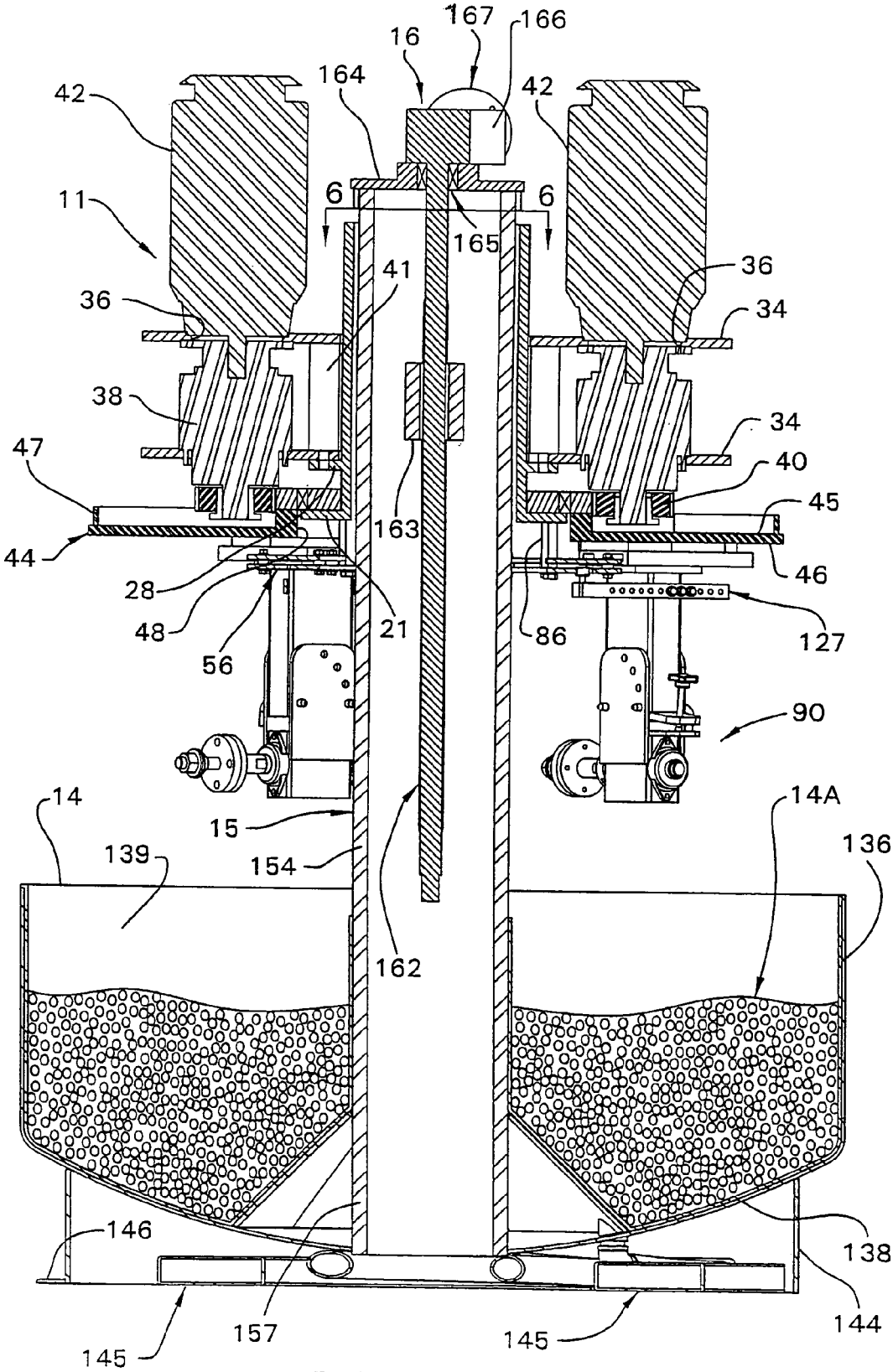
FIG. 3 is an enlarged vertical cross-sectional view of the wheel polishing device.

Referring to FIGS. 1–3, drive assembly 11 additionally includes a pair of motor mounting plates 34. The plates 34 are substantially identical to one another and only one of same will accordingly be described herein. Plate 34 includes a central opening 35 which extends completely through the plate 34 and in the illustrated embodiment is shaped so as to correspond to the outer profile of the mounting sleeve 19. Plate 34 additionally includes a pair of mounting openings 36 disposed on opposite sides of central opening 35. The plates 34 are mounted on the sleeve 19 by lowering plate 34 over the upper end of sleeve 19 so that sleeve 19 projects through central opening 35, and the plate 34 is lowered until same rests upon the upper surface of the respective flanges 28. Fasteners are then used to secure lower plate 34 to the respective flanges 28 utilizing openings 29 and corresponding openings 29A defined in plate 34.

A pair of conventional speed reducers 38 are mounted within the respective openings 36 of lower plate 34. Each speed reducer 38 includes a drive shaft having a lower end which is drivingly connected to a spur gear 40 which projects downwardly beneath lower plate 34. Upper plate 34 is lowered over the upper end of mounting sleeve 19 and spaced upwardly from lower plate 34 via spacers 41. Fasteners project through the respective spacers 41 and fix the upper and lower plates 34 to one another. Conventional electric motors 42 are mounted on the upper plate 34 via the respective openings 36, and are drivingly connected to the respective spur gears 40 through the respective speed reducers 38.

Figure 12:
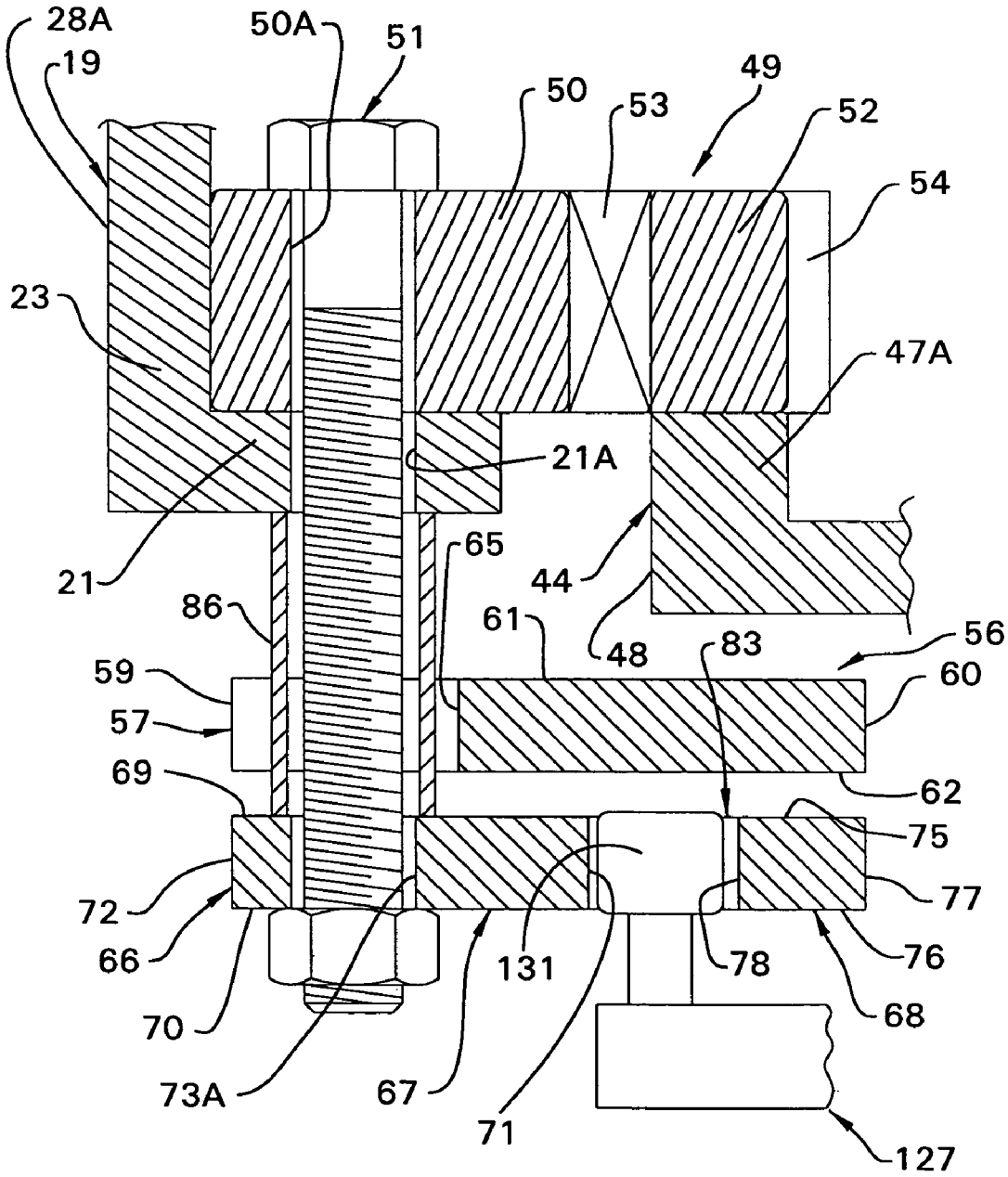
FIG. 12 is an enlarged fragmentary cross-sectional view taken generally along line 12—12 in FIG. 11, and additionally illustrates the mounting of the cam arrangement to the mounting sleeve of the drive assembly, and the cam bar engaged within the track defined between the inner and outer cam rings.

Drive assembly 11 additionally includes a rotatable turret or plate 44 defining upper and lower surfaces 45 and 46 which are generally parallel with one another. In the illustrated embodiment, turret 44 includes a generally vertically oriented annular outer lip 47 which extends upwardly from surface 45 along the outer periphery of turret 44, and an inner annular mounting flange 47A which extends upwardly from surface 45 and defines a central opening 48 in turret 44. As best shown in FIG. 12, turret 44 is mounted on lower flange 21 of sleeve 19 by means of a bearing 49. Bearing 49 includes an inner fixed part 50 which is secured to flange 21 by a plurality of fasteners 51 which are inserted through respective openings 50A of fixed part 50 and through the respective openings 21A of lower flange 21. Bearing 49 additionally includes an outer ring gear 52 which rotates relative to fixed part 50 via conventional rollers 53. Ring gear 52 defines thereon a plurality of teeth 54 which mesh with teeth defined on the respective spur gears 40. The inner mounting flange 47A of turret 44 is fixed to ring gear 52, and when the spur gears 40 are rotated by the respective motors 42, turret 44 is rotated relative to mounting sleeve 19 about a central vertical axis defined by vertical drive assembly 16.

Figure 9:
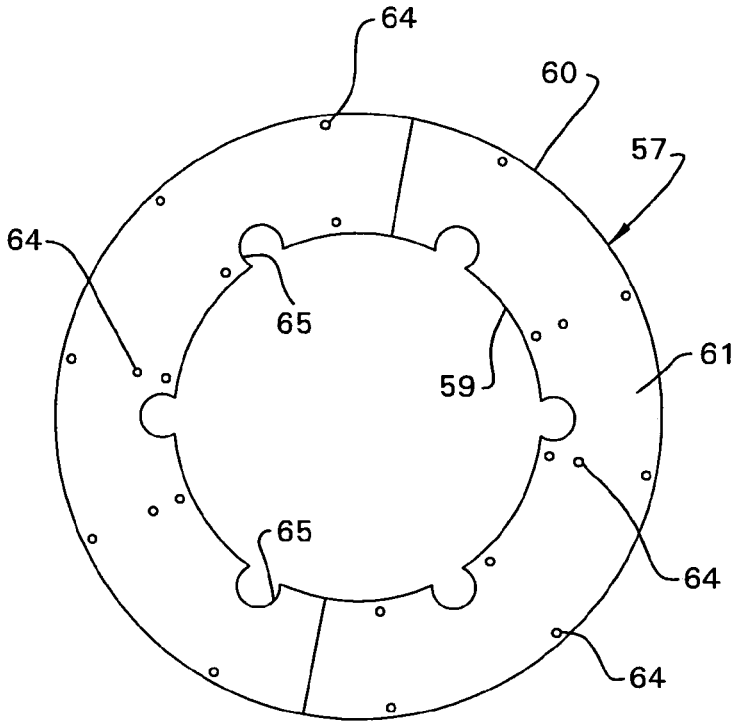
FIG. 9 is an enlarged top view of the cam mounting plate.

Referring to FIGS. 9–12, drive assembly 11 in the illustrated embodiment includes a cam arrangement 56 having a cam mounting plate 57. Cam mounting plate 57 as shown in FIG. 9 is ring-shaped, and defines circular and concentric inner and outer edges 59 and 60. Cam mounting plate 57 defines generally parallel upper and lower surfaces 61 and 62, and additionally defines therein a plurality of holes 64 and a plurality of semi-circular and inwardly opening recesses 65 which project inwardly from inner edge 59. In the illustrated embodiment, for ease of assembly, cam mounting plate 57 is defined by a pair of plates in the shape of half-circles, which plates are then placed so that their respective end edges abut one another to define a closed ring as shown in FIG. 9.

Figure 10:
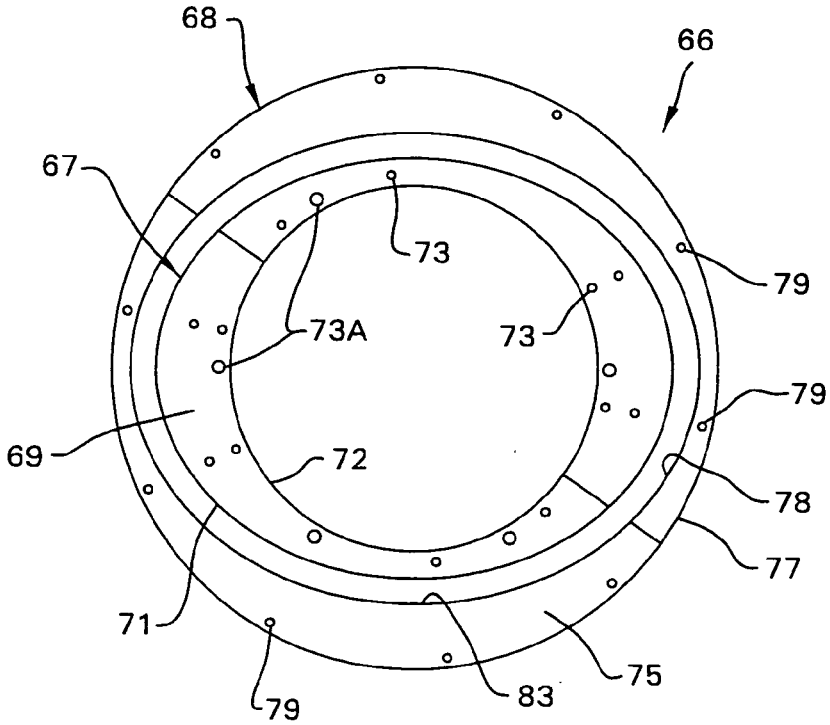
FIG. 10 is an enlarged top view of the inner and outer cam rings.

Cam arrangement 56 additionally includes a cam assembly 66 defined by an inner cam ring 67 and an outer cam ring 68. Inner cam ring 67 defines a pair of generally parallel upper and lower surfaces 69 and 70, an outer elliptically shaped edge 71 and an inner circular edge 72. A plurality of mounting openings 73 and 73A are defined in cam ring 67. The larger of the respective mounting openings 73A receive therein fasteners 51 as discussed below. Outer cam ring 68 defines parallel upper and lower surfaces 75 and 76, an outer circular edge 77 and an inner elliptically shaped edge 78. A plurality of mounting holes 79 are defined in outer cam ring 68. In the illustrated embodiment, for ease of assembly, the inner and outer cam rings 67 and 68 are each defined by a pair of plate-like members which are placed so that their respective end edges abut to define a closed cam ring as shown in FIG. 10.

Figure 11:
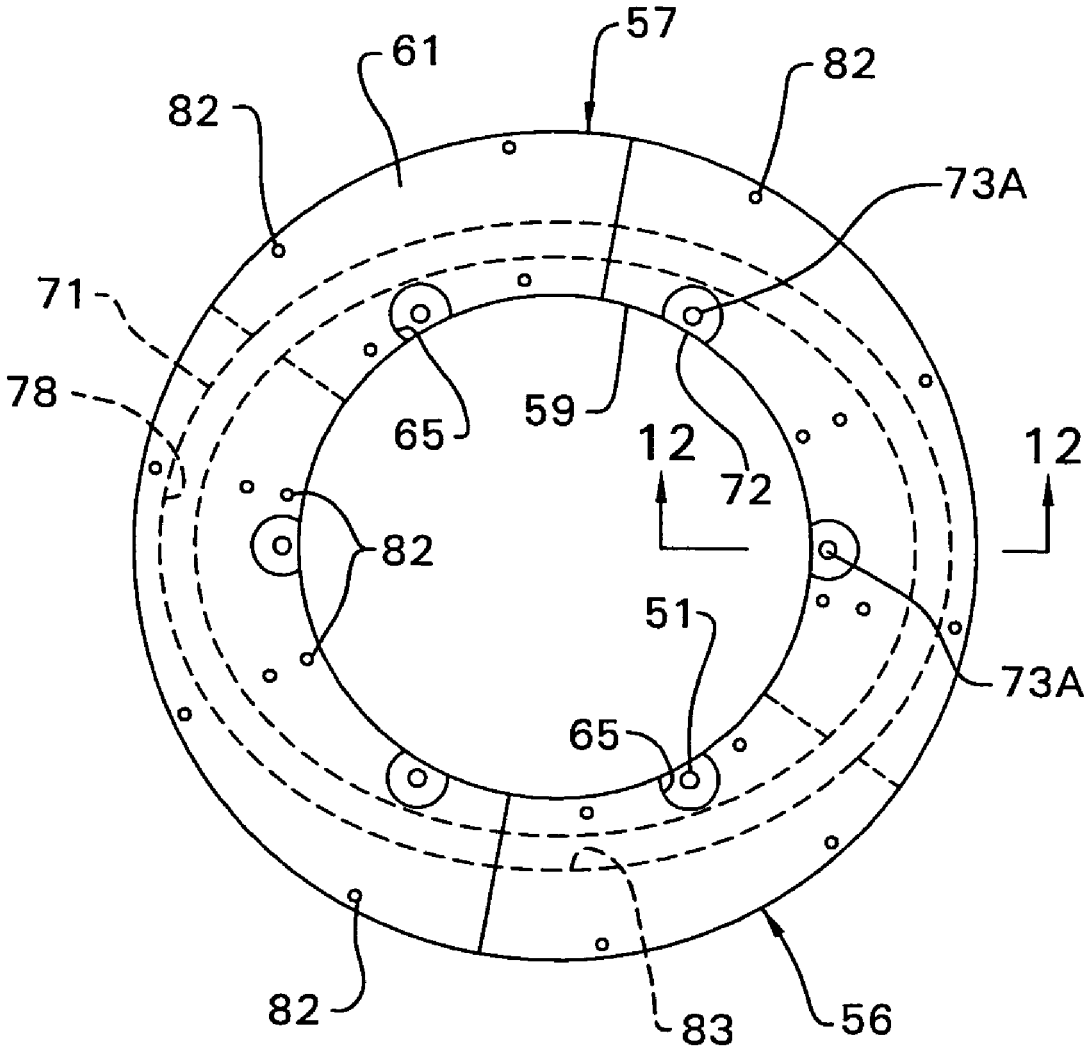
FIG. 11 is an enlarged top view of the cam arrangement with the cam mounting plate assembled to the inner and outer cam rings, wherein the cam mounting plate is positioned over the inner and outer cam rings.

Referring to FIGS. 11 and 12, inner and outer cam rings 67 and 68 are positioned adjacent the lower surface 62 of cam mounting plate 57 and are fixed thereto by fasteners 82 which extend through the correspondingly positioned openings 64 of plate 57 and openings 73 and 79, of cam rings 67 and 68. Fasteners 82 extend through spacers positioned between the lower surface 62 of mounting plate 57 and the upper surfaces 69 and 75 of cam rings 67 and 68 of cam plate assembly 66, which spacers position the cam rings 67, 68 in coplanar relation with one another, and vertically downwardly from and in parallel relation with mounting plate 57. It will be appreciated that the inner diameter of inner cam ring 67 defined by edge 72 is similar to the inner diameter of cam mounting plate 57 defined by edge 59, and the outer diameter of outer cam ring 68 defined by edge 77 is similar to the outer diameter of cam mounting plate 57 defined by edge 60. The inner and outer cam rings 67 and 68 so positioned under cam mounting plate 57 together define a cam slot or track 83, which track 83 is defined by the outer edge 71 of inner cam ring 67 and the inner edge 78 of outer cam ring 68. In the illustrated embodiment, the track 83 is elliptically shaped.

The cam arrangement 56 as assembled above is mounted to the lower flange 21 of sleeve 19 via bolts 51, which bolts 51 extend downwardly through the openings 21A in lower flange 21, pass through the respective recesses 65 in cam mounting plate 57 and into the correspondingly located openings 73A defined in inner cam ring 67. Spacers 86 as shown in FIG. 12 are positioned between the lower surface of flange 21 and the upper surface 69 of inner cam ring 67 to position the cam arrangement 56 in downwardly spaced relation from flange 21 and turret 44.

Figure 7:
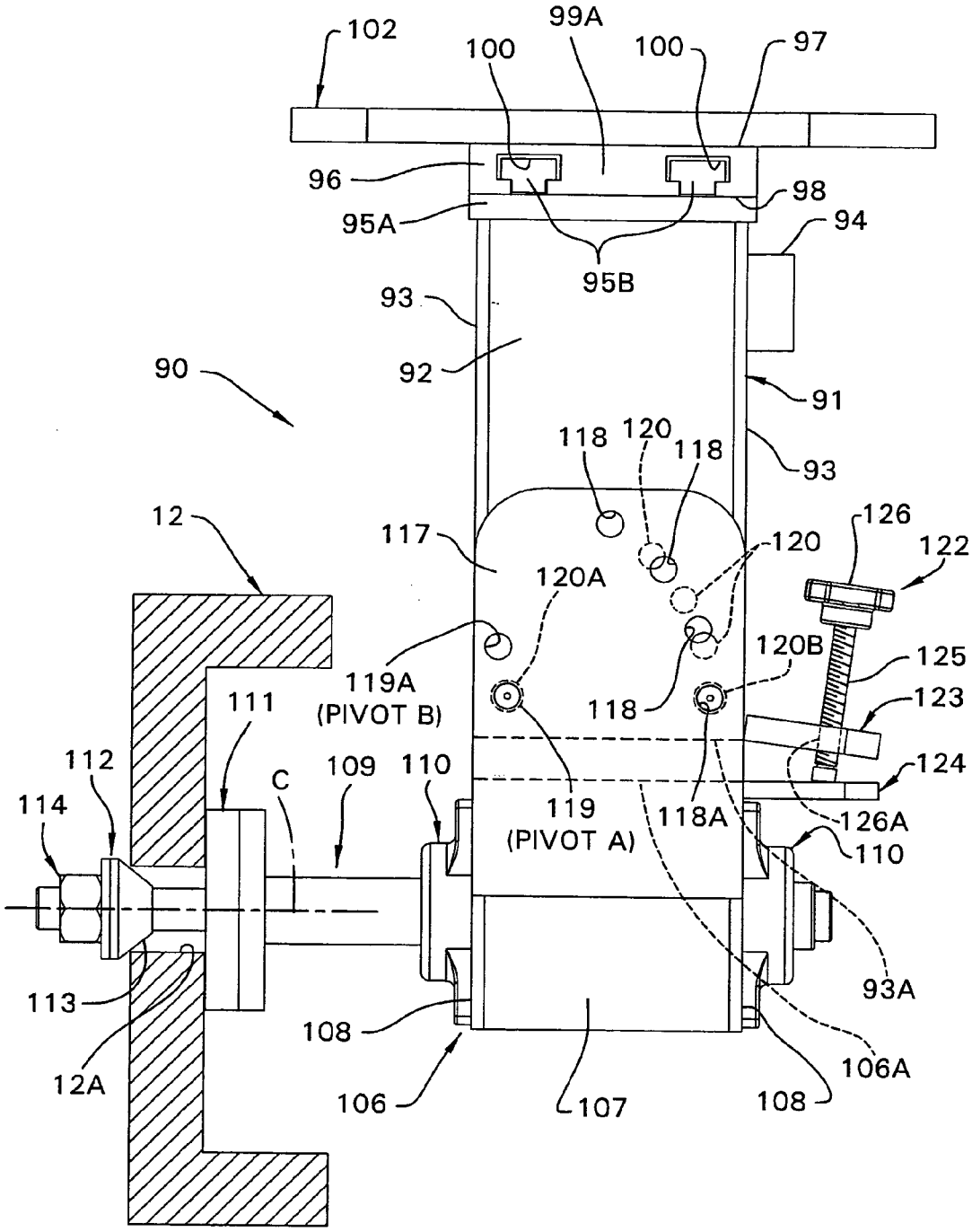
FIG. 7 is an enlarged side elevational view of a wheel mounting assembly, with the wheel mounted thereon shown in cross-section.
Figure 8:
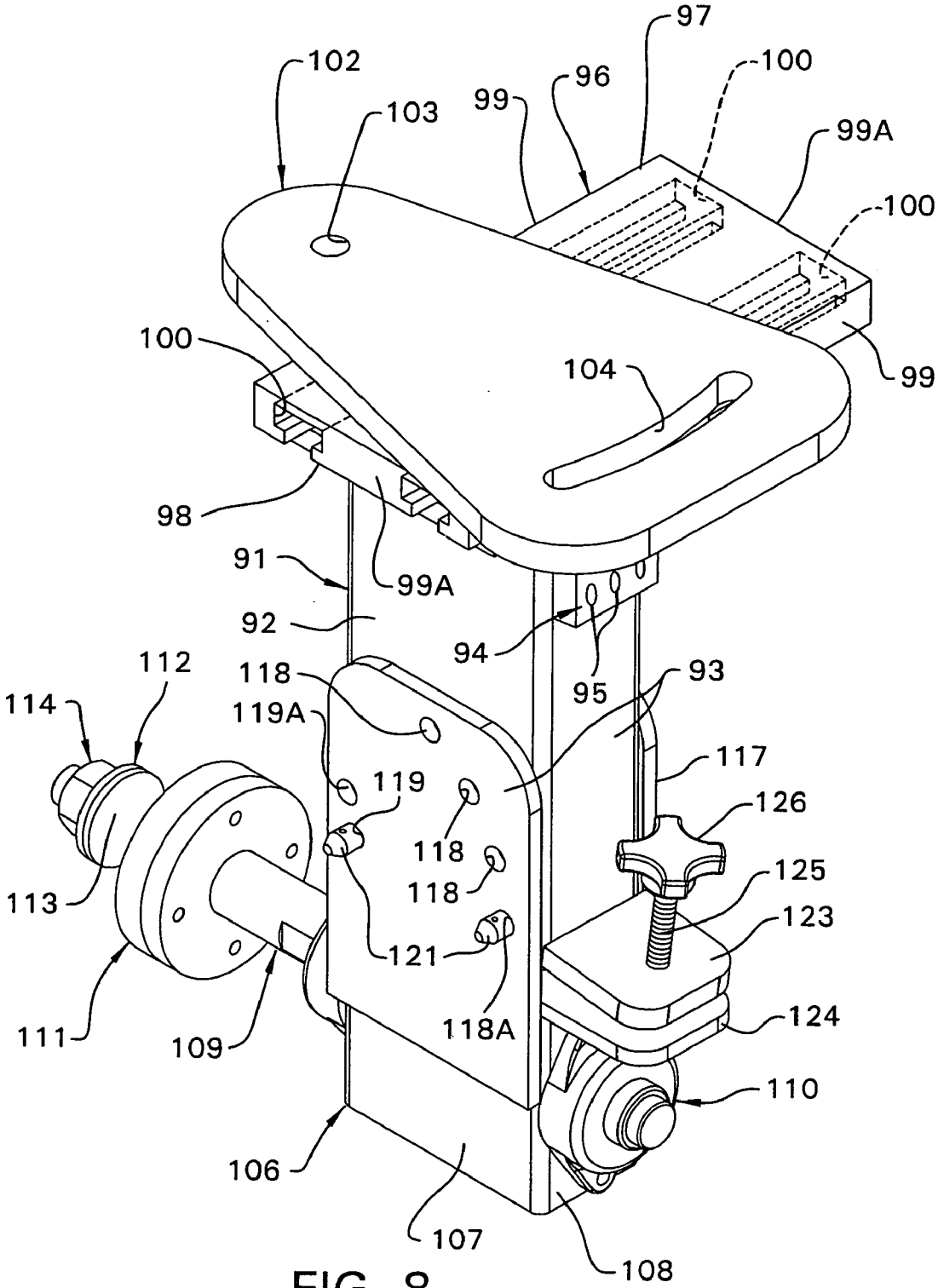
FIG. 8 is a perspective top view of the wheel mounting assembly of FIG. 7.

Drive assembly 11 also includes a plurality, and here four, of wheel mounting assemblies 90 which are cantilevered downwardly from turret 44 and disposed in equally spaced relation with one another circumferentially along the lower surface 46 of turret 44. The wheel mounting assemblies 90 are identical to one another, and only one such assembly will therefore be described herein. Referring to FIGS. 7 and 8, the wheel mounting assembly 90 includes an upright support arm 91 which is generally rectangular in transverse cross-section and defined by a pair of generally parallel side walls 92 joined to one another by a pair of generally parallel end walls 93 which extend transversely between side walls 92. The upper end of the support arm 91 mounts thereon a cam bar mounting block 94 which defines therein a plurality of threaded openings 95 arranged in a horizontal row.

A plate 95A is fixed to the upper end of support arm 91. Plate 95A has fixed thereto two pairs of generally T-shaped slide nuts 95B (only two of which are shown in FIG. 7). A generally rectangular slide plate 96 is positioned atop plate 95A and defines upper and lower surfaces 97 and 98, a pair of longitudinal edges 99 and a pair of end edges 99A which extend transversely between the respective edges 99. Slide plate 96 defines therein a pair of generally parallel, elongate and T-shaped slots 100. Slots 100 extend across the entire longitudinal extent of plate 96 and open both downwardly through lower surface 98 and sidewardly through the respective end edges 99A. As shown in FIG. 7, the slide nuts 95B are engaged within the respective slots 100 to permit relative movement between support arm 91 and slide plate 96.

An arm mounting plate 102 is fixed to the upper surface 97 of slide plate 96, which arm mounting plate 102 at one end defines therein an opening 103 which defines a pivot point for the respective wheel mounting assembly 90 relative to the turret 44 as discussed below, and at the opposite end defines an arcuate slot 104 which permits variation of the yaw angle of the respective wheels 12 as discussed below.

Wheel mounting assembly 90 further includes a lower wheel mounting part 106 which is generally rectangular in cross-section and defined by a pair of parallel side walls 107 and a pair of parallel end walls 108 which interconnect and extend transversely between the respective side walls 107. Wheel mounting part 106 supports a spindle 109 by means of a pair of bearings 110 located on opposite sides of mounting part 106, which bearings 110 permit rotation of spindle 109 relative to mounting part 106. A wheel supporting plate or backing plate 111 is fixed to spindle 109 in laterally spaced relation from bearing 110, and a retaining ring 112 is supported on spindle 109 outwardly from plate 111. As shown in FIG. 7, ring 112 defines thereon a conical surface 113 which faces inwardly towards wheel supporting plate 111. A retaining nut 114 is threadingly engaged with the terminal end of the spindle 109 adjacent ring 112.

The wheel 12 is mounted on the lower part 106 by removing the retaining nut 114 and ring 112, inserting the outer free end of the spindle 109 into the wheel opening 12A, assembling the ring 112 onto spindle 109, and then advancing ring 112 towards wheel 12 to insert the tapered surface 113 of ring 112 into the wheel opening 12A until surface 113 engages the wheel 12. The retaining nut 114 is then screwed onto the end of the spindle 109 to fix wheel 12 between ring 112 and plate 111. The conical or tapered surface 113 of ring 112 serves as an adapter to permit the mounting of different sizes of wheels 12. It will be appreciated that other forms of wheel securing arrangements may be utilized in place of the above. For example, a quick-change arrangement incorporating a spring and detent may be utilized to allow more rapid mounting of the wheels 12.

The lower part 106 is connected to the support arm 91 by a pair of spaced-apart and identical brackets 117. The brackets 117 are fixed to the respective side walls 107 in vertically upwardly spaced relation from the lower edges of side walls 107, such that lower part 106 is sandwiched between side walls 107. Each bracket 117 defines therein a series of adjustment openings 118 and 118A which are arranged in an arcuate pattern. A further opening 119 is defined adjacent the opposite side of the respective bracket 117 and is horizontally aligned with lowermost opening 118A, and an opening 119A is defined in each bracket 117 slightly above and slightly outwardly from the respective opening 119. Openings 119 and 119A define respective pivot points A and B of the lower part 106 relative to support arm 91 as discussed below. It will be appreciated that the openings 118, 118A in each bracket 117 are horizontally and vertically aligned with one another on opposite sides of arm 91. Likewise, openings 119, 119A in each bracket 117 are horizontally and vertically aligned with one another.

As shown in dotted lines in FIG. 7, support arm 91 also defines a series of openings 120 in each of the side walls 92 thereof. The openings 120 are vertically and horizontally offset relative to the respective openings 118 in brackets 117, and a lowermost opening 120B corresponds in location to lowermost openings 118A of the respective brackets 117. Further, side walls 92 each additionally define an opening 120A which corresponds in location to openings 119 of brackets 117. All of the above openings are sized to receive elongate adjustment pins 121.

A stabilizing arrangement 122 is also provided on wheel mounting assembly 90. Stabilizing arrangement 122 includes upper and lower stabilizer plates 123 and 124. Upper plate 123 is fixed to end wall 93 of support arm 91 adjacent a lowermost end 93A thereof (shown in dotted lines), and lower plate 124 is fixed to end wall 108 of lower part 106 adjacent an uppermost end thereof 106A (shown in dotted lines). A screw 125 mounting a knob 126 on an upper end thereof is threadingly engaged within a threaded opening 126A defined in upper plate 123. The lower end of screw 125 rests upon an upper surface of lower plate 124.

The openings defined in the respective brackets 117 and support arm 91 permit the pitch of the axis C of the wheel 12 (as defined by spindle 109) to be adjusted relative to the horizontal. Once the wheel 12 is mounted on spindle 109 as discussed above, if it is desirable to position the wheel axis C parallel to the horizontal, then lower part 106 is positioned relative to arm 91 so that the openings 119 and lowermost opening 118A of brackets 117 are aligned with corresponding openings 120A and 120B of support arm 91, and respective pins 121 are then inserted through opening 119 and lowermost opening 118A of one bracket 117, through openings 120A and lowermost opening 120B of arm 91, and then through openings 119 and lowermost opening 118A of the opposite bracket 117.

If it is desirable to adjust the pitch of the wheel 12 positively or upwardly, a pin 121 is positioned in openings 119 of brackets 117 and 120A of arm 91 (pivot A), and the lower part 106 is pivoted upwardly about pivot A (in a clockwise direction in FIG. 7) to align a selected one of the upper openings 118 of brackets 117 with lowermost openings 120B of arm 91. A pin 121 is then positioned so as to project through the aligned openings. It will be appreciated the uppermost opening 118 of each bracket 117 will provide the greatest positive pitch angle of the wheel 12, with the openings located between the uppermost opening 118 and the lowermost opening 118A providing intermediate angles of pitch. Further, the openings 120 of arm 91 which are offset from openings 118 effectively provide a further range of available pitch angles, for example by placing the rightwardmost pin 121 through the openings 118 immediately adjacent lowermost openings 118A and through openings 120 of arm 91 immediately adjacent lowermost openings 120B.

To adjust the pitch downwardly, pivot B is utilized. That is, the lower part 106 is positioned relative to arm 91 to bring bracket openings 119A (which define pivot B) into alignment with openings 120A of support arm 91, which serves to lower the lower part 106 relative to support arm 91. The lower part 106 is then pivoted downwardly about pivot B (in a counterclockwise direction in FIG. 7), so that the openings 118 located immediately adjacent lowermost openings 118A are aligned with openings 120 of arm 91 immediately adjacent lowermost openings 120B.

Once the pitch of the wheel axis C is adjusted to the desired angle, then the stabilizer arrangement can be utilized to prevent any relative movement or "slop" between the arm 91 and the lower part 106, simply by rotating knob 126 to lower the screw 125 into abutting contact with lower plate 124. In addition, when adjusting the pitch upwardly as discussed above, the weight of the wheel 12 can be significant and thus the stabilizer arrangement 122 can be utilized to assist this adjustment, if necessary. That is, with a pin 121 in place at pivot A, the screw 125 can be lowered by rotating knob 126 which will effectively force lower plate 124 downwardly and cause spindle 109 to pivot upwardly about pivot A. The arrangement 122 can also be used to hold lower part 106 in position during alignment of the openings to allow placement of the pins 121 in the selected positions.

Figure 8B:
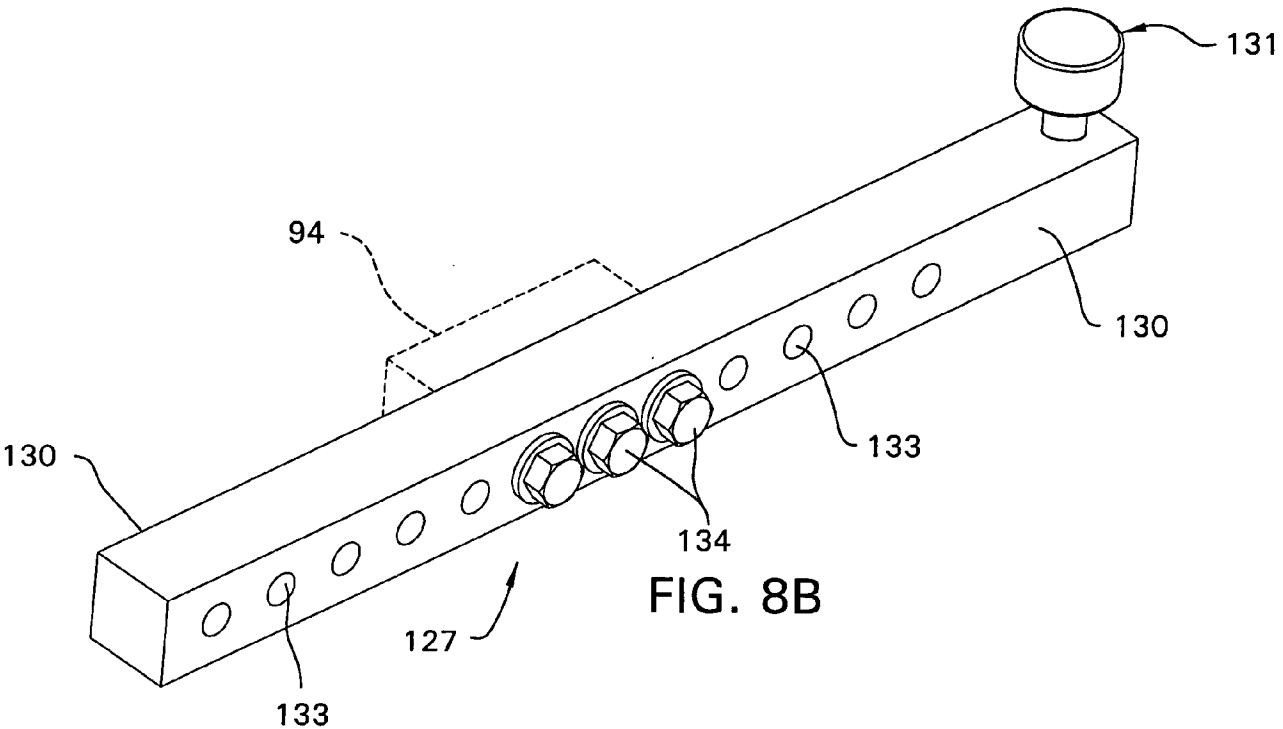
FIG. 8B is a perspective top view of the cam bar of FIG. 8A.
Figure 8A:
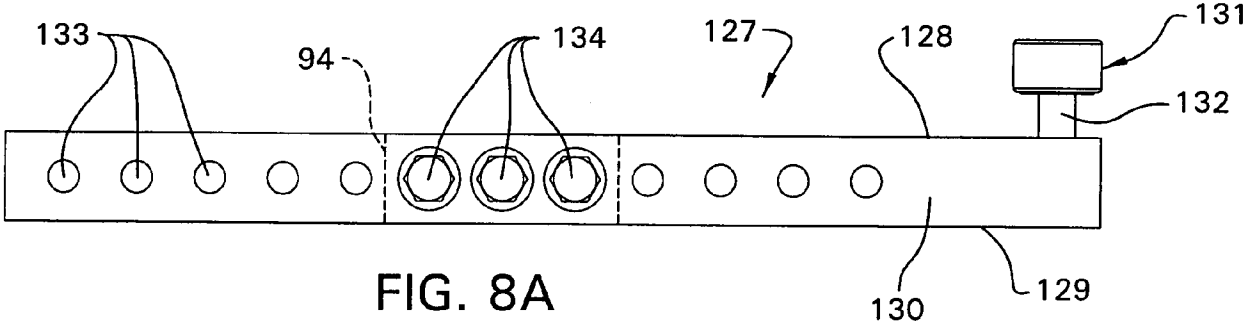
FIG. 8A is a side view of a cam bar.

As shown in FIGS. 8A and 8B, drive assembly 11 additionally includes an elongate cam bar 127 defining generally parallel upper and lower surfaces 128 and 129 and a pair of generally parallel side surfaces 130 which extend between upper and lower surfaces 128 and 129. A follower 131 is cantilevered upwardly from upper surface 128 by means of a stem 132 having a lower end fixed within cam bar 127. A series of spaced openings 133 are defined within cam bar 127 along the longitudinal extent thereof, wherein selected ones of the openings 133 receive fasteners 134 therein which extend through bar 127 and into the mounting block 94 to secure the cam bar 127 to the respective support arm 91.

Figure 13:
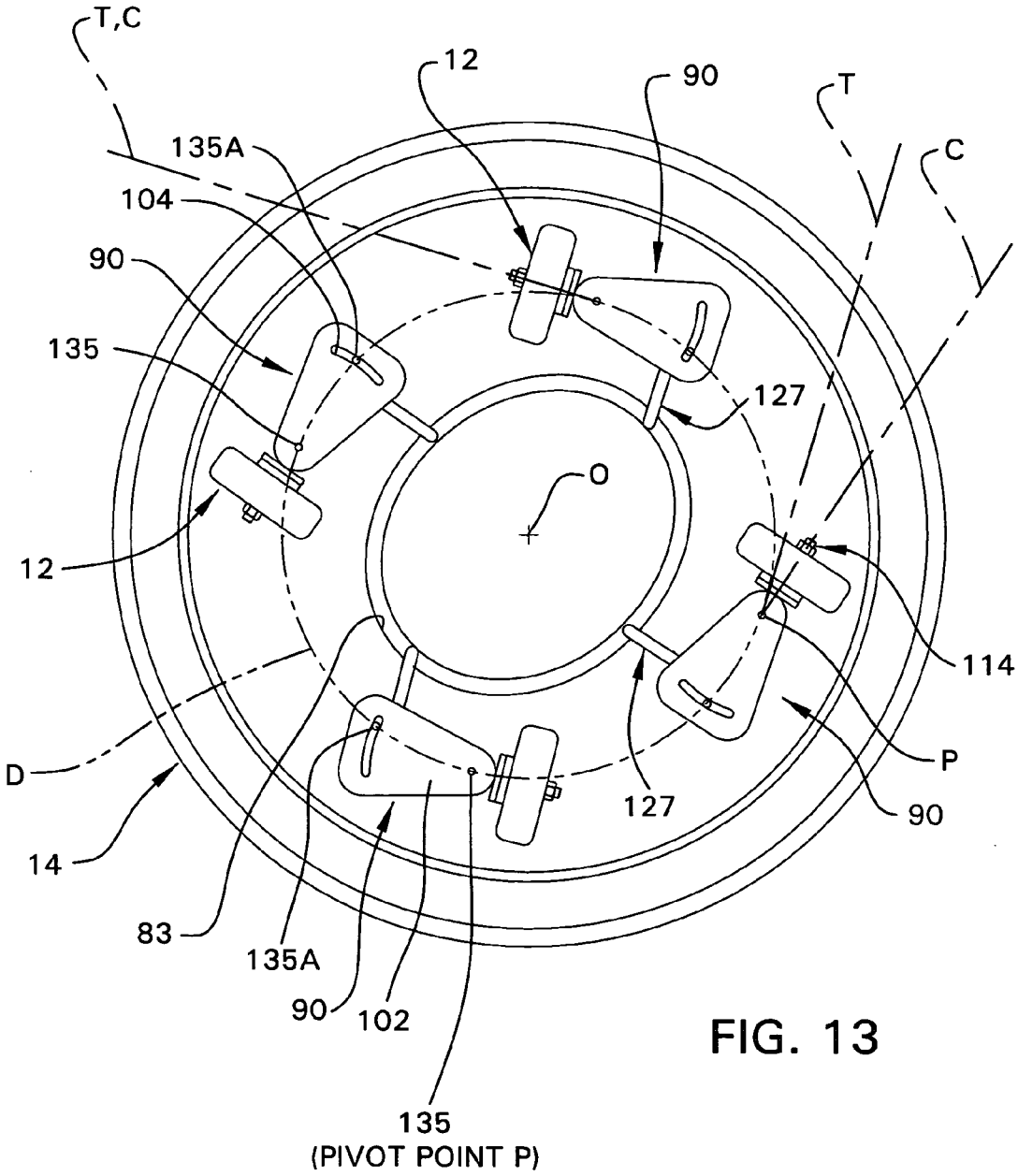
FIG. 13 is a diagrammatical overhead view of the wheel polishing device illustrating the travel of one wheel mounting assembly and the associated wheel along the cam arrangement during operation.

With reference to FIG. 13, the respective wheel mounting assemblies 90 are secured to the lower side of the turret 44 via fasteners 135 and 135A. Each fastener 135 extends upwardly through opening 103 of upper plate 102 and into turret 44 and defines a pivot point P of wheel mounting assembly 90 relative to turret 44. Further, each fastener 135A extends upwardly through the respective arcuate slot 104 of upper plate 102 and into turret 44. The cam bars 127 are secured to the respective support arms 91 so that the cam bars 127 are oriented in perpendicular relation with their respective arms 91, and so that the cam bars 127 extend inwardly with the respective followers 131 projecting upwardly for engagement within track 83.

Turning now to bowl assembly 13 and with reference to FIG. 3, the bowl 14 thereof is defined by an outer cylindrical wall 136 which is generally upright and concentrically surrounds support 15, and a bottom wall 138 which extends between wall 136 and support 15. The outer and bottom walls 136 and 138 together with support 15 define an annular channel 139 which contains therein the abrasive media 14A. The bowl 14 is stabilized for horizontal orientation by a lower annular support wall 144 which extends downwardly from bottom wall 138. A pair of cross members 145 extend in a parallel manner with one another between opposite sides of the support wall 144, and are rigidly fixed thereto. A plurality of corner-shaped floor mounting flanges 146 are fixed to an outer upright surface of support wall 144 to allow for securement of the wheel polisher 10 to a support surface, such as a floor. The cross members 145 define a pair of rigid supports to permit movement of the polishing device 10, such as by a forklift or other moving device suitable for moving heavy machinery.

Figure 4:
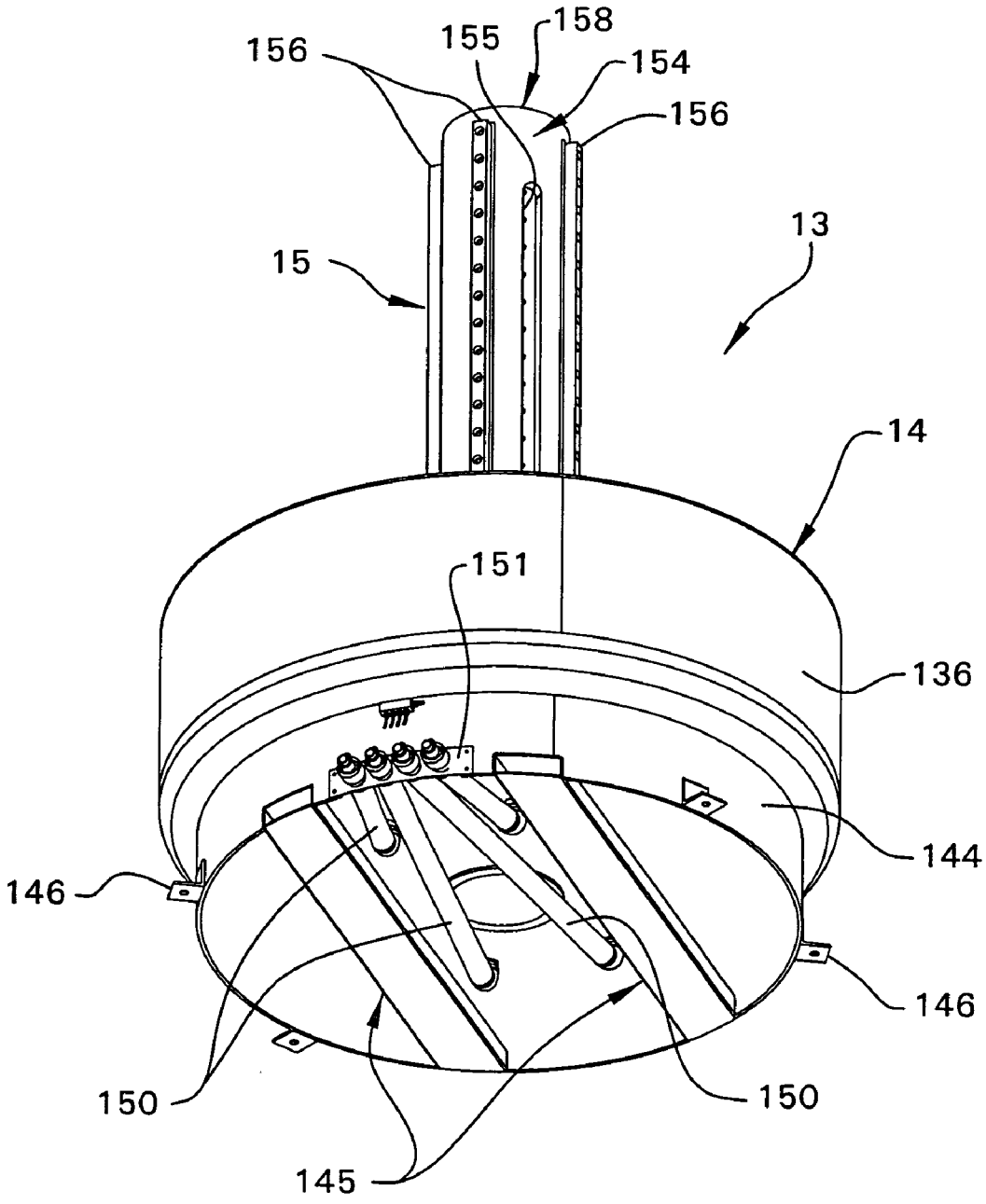
FIG. 4 is a perspective bottom view of the wheel polishing device, without the drive assembly.

As shown in FIG. 4, bowl assembly 13 includes a plurality of conduits or pipes 150 for drainage of liquids and for applying a vacuum to the interior of the bowl 14. Upper open ends of the pipes 150 extend through the bottom wall 138 of the bowl 14 and communicate with channel 139. Opposite ends of the pipes 150 exit through support wall 144 and are supported thereat by a plate 151. In the illustrated embodiment, four of such pipes 150 are provided with the open upper ends thereof disposed about the circumference of bottom wall 138. It will be appreciated, however, that a greater or lesser number of pipes may be utilized.

As shown in FIGS. 3, 4 and 6, upright support 15 forms part of bowl assembly 13, and projects upwardly therefrom. Support 15 includes a cylindrical side wall 154 which defines therein a pair of diametrically opposed and vertically extending elongate slots 155. Slots 155 terminate a short vertical distance above the uppermost edge of bowl 14, and terminate a short vertical distance downwardly below the uppermost edge of side wall 154. A plurality, and here four, of outwardly projecting guides 156 are provided in circumferentially spaced relation about the periphery of side wall 154, at equal distances from one another. The outer diameter of support 15 and the dimensions of the respective guides 156 thereof are sized so that support 15 nests within the central opening 28A and the respective channels 25 of mounting sleeve 19. The guides 156 extend along a significant vertical extent of the support 15 and terminate a short distance above the upper edge of bowl 14. A lower end 157 of support 15 is positioned adjacent the lowermost extent of bowl 14, and an upper end 158 of support 15 mounts the vertical drive assembly 16 thereon.

Referring to FIGS. 1 and 3, vertical drive assembly 16 includes a vertically elongate drive shaft or ball screw 162 which extends downwardly into the hollow interior of support 15, and is rotatable about and defines a generally vertically extending axis. A rotatable nut 163 surrounds and is threadingly engaged on shaft 162. The shaft 162 is mounted within the support 15 for rotation by a shaft mounting arrangement including a plate 164 which closes off the open upper end of support 15 and mounts thereon a bearing 165 which supports the shaft 162 for rotation relative to support 15. The lower end of the shaft 162 may also be supported for rotation by a lower bearing (not shown). The shaft 162 is rotatably driven by an electric motor 167, which motor 167 is supported on plate 164, through a suitable drive train 166 shown schematically in FIG. 3, such as a gearbox or belt arrangement. Motor 167 is of conventional construction and possesses its own internal brake which activates to prevent rotation of the drive motor shaft whenever the motor 167 is de-energized.

Sleeve 19 is mounted on upright support 15 by aligning guides 156 of support 15 with the respective channels 25 of sleeve 19 and sliding the sleeve 19 downwardly over the upper end 158 of support 15. Fasteners 170 are inserted into the respective openings 27 of sleeve 19, through the respective slots 155 of support 15, and into corresponding threaded openings 171 defined in nut 163 (FIG. 6). This arrangement thus permits the drive assembly 11 to travel upwardly or downwardly along with nut 163 within the respective slots 155 upon rotation of drive shaft 162.

A control unit 172 as shown in FIG. 1 is provided for displaying various operational conditions and allowing operator input and control of the device 10 through suitable software, such as through a touch sensitive display panel 173 and/or various push button controls 174.

In operation, one or more wheels 12 are mounted and secured on the respective wheel mounting assemblies 90 as discussed above, with the turret 44 in a raised position relative to bowl 14. The pitch of the individual wheels 12 is then adjusted to the appropriate angle utilizing the pins 121 and openings defined in the brackets 117 and support arms 91. For example, when a light polishing or finishing is desired, the pitch is typically adjusted upwardly so the media 14A is less resistant and flows more freely over the wheel 12 to lightly polish same. When a more aggressive polishing or finishing is desired, then the pitch is typically adjusted downwardly which tends to increase the resistance of the media and compress same against the wheel 12. The positions of the respective support arms 91 relative to upper mounting plate 102 and turret 44 to which plate 102 is fixed are adjusted by sliding nuts 95B within the slots 100 of slide plate 96, which allows positional adjustment of the wheel 12 relative to the support 15 and the opposed outer wall 136 of bowl 14. The cam bars 127 are then attached to the blocks 94 on the respective support arms 91, utilizing the appropriate openings 133 defined in cam bar 127 to effectively adjust the length of the cam bar 127 to allow engagement of the respective followers 131 within track 83.

Using control unit 172, the motors 42 are actuated to cause rotation of the turret 44 and the respective wheels 12 about the vertical axis defined by drive screw 162, and motor 167 is actuated to rotate screw 162 in the appropriate direction to lower drive assembly 11 and the wheels 12 supported thereon into contact with media 14A. During rotation of turret 44, the wheels 12 travel within bowl 14 along a circular orbital path D, as shown in FIG. 13. The cam arrangement 56 which defines track 83 and the engagement of followers 131 within same causes each wheel mounting assembly 90 (including plate 102) and the wheel 12 mounted thereon to continuously oscillate inwardly and outwardly (with respect to FIG. 13) about a vertical axis defined by fastener 135 (pivot point P). During this oscillation, the pivoting movement of the wheel mounting assembly 90 is limited by arcuate slot 104 defined in plate 102. In the illustrated embodiment, the cam track 83 is elliptical in shape, and each wheel 12 undergoes two cycles of this inward/outward movement per revolution as shown in FIG. 13. The oscillation of the wheels 12 about their respective vertical pivot points P also causes the wheels 12 to freewheel about their respective axes C defined by spindles 109, which provides better media coverage over the wheel, and also tends to break up media flow and provide a more randomized media flow during processing.

If desirable or necessary, the wheels 12 can also be vertically oscillated during processing. More specifically, after the wheels 12 are initially lowered into the bowl 14 through the lowering of drive assembly 11 as discussed above, the wheels 12 can be raised and lowered within the media 14A while orbiting around the bowl 14 by sequentially driving screw 162 in opposite rotational directions with motor 167.

As shown in FIG. 13, during processing and due to cam arrangement 56, the wheel axis C of wheel 12 swings outwardly relative to a tangent T intersecting pivot point P, and then swings back inwardly such that the wheel axis C coincides with tangent T. Thus, the front face of wheel 12 is always oriented at an angle relative to a radial plane intersecting the center O of orbital path D, which causes freewheeling of the wheel 12 about its axis C. In this regard, if wheel axis C were positioned so that axis C is tangential to the orbital path D at the front face of wheel 12 (i.e. at nut 114), the wheel 12 would not freewheel about its axis C. This latter arrangement is not desirable since the media would tend to stagnate. According to the invention, the wheel 12 during processing is moving orbitally, rotationally about its axis C and pivotally about pivot P (and vertically if desirable), which mixes the media and results in an improved finish.

The pivoting of the wheels 12 about their vertical axes 135 as well as the vertical oscillation of the wheels 12 within the media 14A serves to mix and break up the media 14A within the bowl 14, and to essentially randomize the media flow pattern. This randomization prevents the formation of stagnant pockets of media within the bowl 14 and within the openings and various crevices defined within the wheel 12 itself. Further, the formation of unwanted grooves or patterns of grooves on the wheel 12 caused by stagnant media can be prevented. The cam arrangement 56 described herein advantageously automatically and continuously varies the angular position of the wheel face relative to the media 14A during its orbit about bowl 14, which results in better media coverage and more uniform finishing of the wheel face and rims.

It may also be desirable to include additional measures to mix the media within bowl 14 and randomize the media flow pattern. For example, elongate stirs can be mounted on the turret 44 so as to project downwardly from the lower surface thereof and into the media 14A. As the turret 44 rotates, the stirs rotate therewith and mix the media. The stirs may also be provided with propellers at lower ends thereof.

The frameless design of the wheel polishing device 10, that is, the support of the drive assembly 11 and vertical drive assembly 16 by means of the center support 15 and bowl assembly 14, allows the device 10 to be easily moved without the need for disassembly, since the device 10 can be moved simply by lifting the device 10 using the cross members 145, such as with a forklift. The frameless design also provides the device 10 with a relatively compact and space-saving footprint.

During operation of the device, it is preferable to essentially fully submerge the wheels 12 so that the front faces thereof are covered with media 14A. Submerging the wheels in this manner causes media to flow upwardly and over the front and rear rims of the wheel 12 against which the tire seals. The polishing of the wheel rims through the flow of media thereover thus provides a smoother, and thus an improved sealing surface for the tire.

It will be appreciated that the type of media 14A may vary depending upon the application. For example, the finishing media 14A may include loose, particulate, and solid finishing materials, whether natural or synthetic, including stone, porcelain, abrasive-filled clays, plastics, ceramics, wood, leather, cobmeal, or the like. Further, the device as disclosed herein may be utilized for dry processing of the wheels 12, or wet processing may be employed. During wet processing, a finishing liquid or liquids are typically used in conjunction with solid media. The finishing liquid may be washing fluid, rinsing fluid, inhibitor solutions, and the like. During wet processing, pipes 150 can be utilized for drainage of these fluids as necessary. During dry processing, the pipes 150 can be utilized for applying a vacuum to the interior of the bowl to remove dust and other fine particles.

It will be appreciated that the other types of cam arrangements may be utilized in place of the illustrated cam arrangement 56 illustrated herein. For example, track 83 need not necessarily be elliptically-shaped, and can have any eccentric shape. Further, cam arrangement 56 can be replaced with a circular plate-like cam having one or more projections at its outer circumference, and followers 131 can simply ride along the outer periphery of the cam such that when the cam projection is encountered by the respective follower 131, the cam projection causes pivoting movement of the wheel mounting assembly 90 about its vertical pivot axis 135 as the follower 131 passes over the cam projection.

It will also be appreciated that the pin/opening arrangement illustrated herein for adjusting the pitch or rake angle of the wheels 12 is only one type of arrangement which may be utilized. For example, additional openings can be provided in the respective brackets 117 and support arm 91 below the position of the illustrated openings to define additional adjustment positions when a downward adjustment of the pitch is desired. This type of arrangement would thus eliminate the need for two pivot points for brackets 117.

It will be understood that the polishing device 10 may be utilized to finish workpieces other than the wheels 12 discussed herein. For example, workpieces may be mounted on respective support arms so as to project downwardly into the media 14A for finishing. Further, workpieces may also be mounted on a rotating turret which projects downwardly from turret 44 and into the media 14A.

Figure 14:
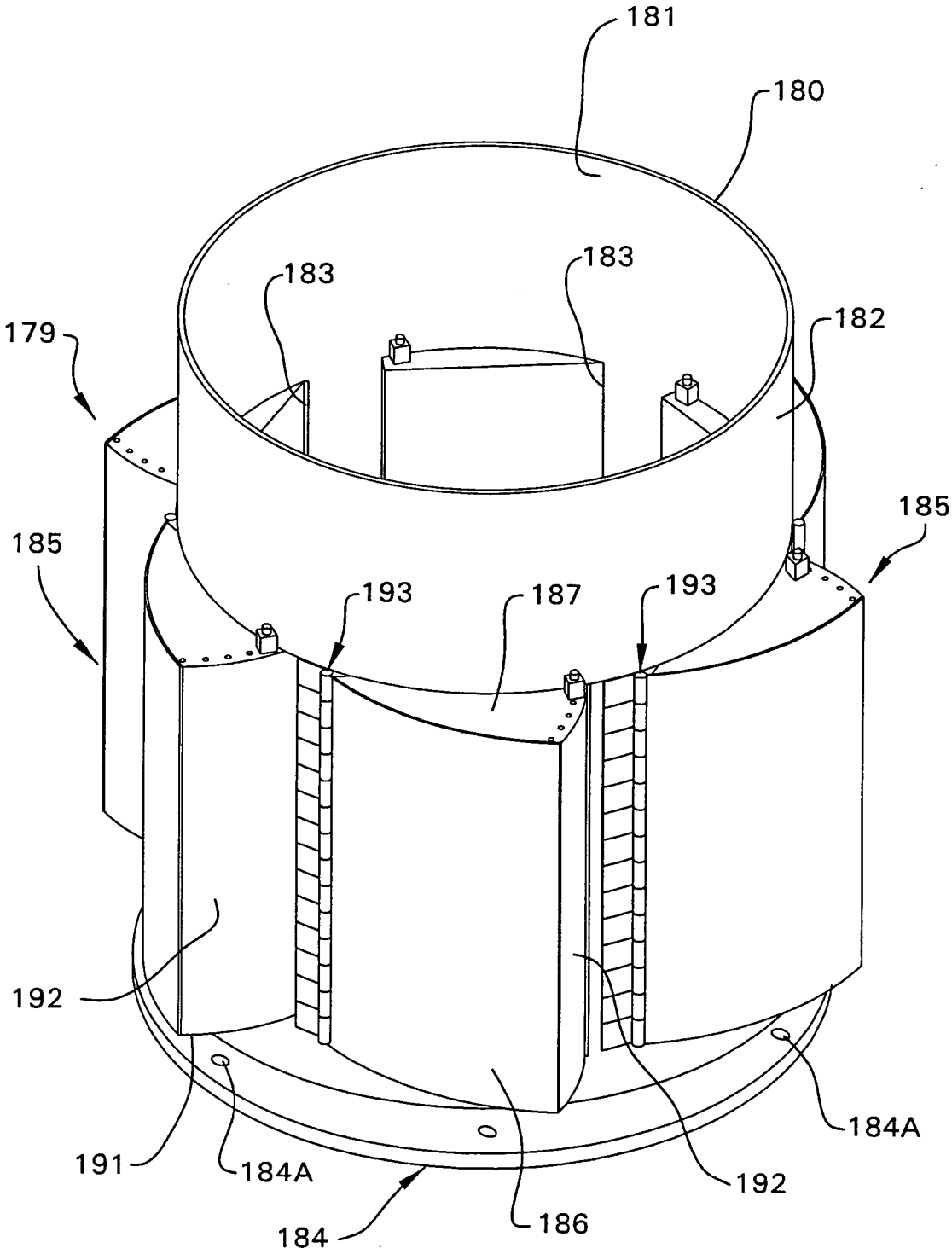
FIG. 14 is an enlarged perspective top view of a hub arrangement which may be utilized with the wheel polishing device.
Figure 15:
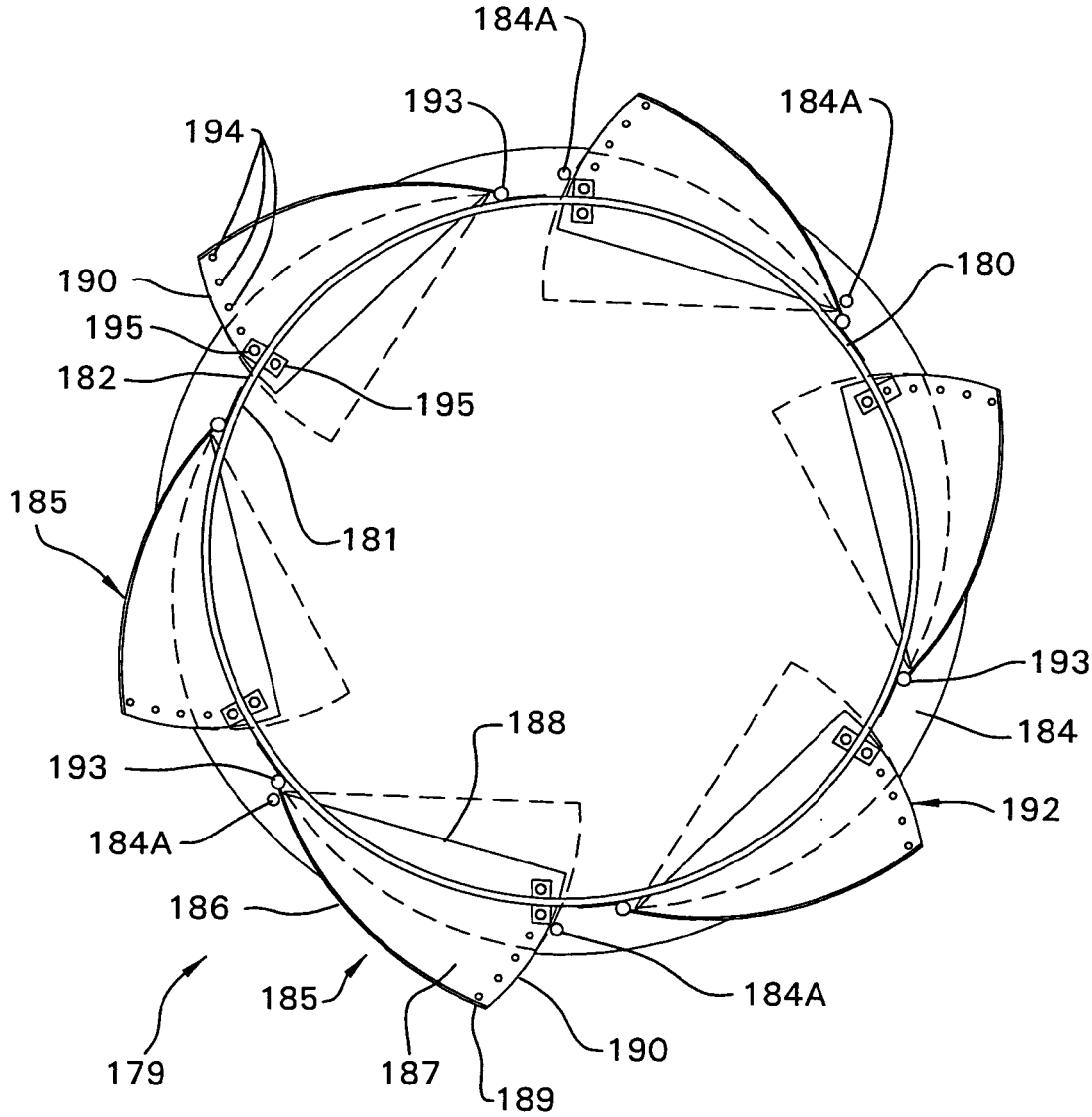
FIG. 15 is an enlarged top view of the hub arrangement of FIG. 14.

FIGS. 14 and 15 illustrate a hub arrangement 179 which may be utilized with device 10. Hub arrangement 179 includes a generally upright cylindrical wall 180 defining inner and outer surfaces 181 and 182. A plurality of generally rectangular openings 183 are defined in wall 180 in circumferentially spaced relation with one another. A lower flange 184 is fixed to a lower annular edge of wall 180 and defines openings 184A therein for mounting within bowl 14. Hub arrangement 179 additionally includes a plurality of deflectors or wings 185 which are mounted to the cylindrical wall 180. The deflectors 185 are identical to one another and only one of which will therefore be described herein. Deflector 185 is defined by an arcuate and upright outer wall 186 which along an upper edge thereof is joined to a generally horizontal and planar top wall 187. As shown in FIG. 15, top wall 187 is generally triangular in shape and has a straight inner edge 188, an arcuate outer edge 189 and a convex end edge 190 which interconnects the inner and outer edges 188 and 189. Inner and outer edges 188 and 189 intersect one another at a point defined along the hinge axis of the deflector 185 opposite edge 190 as discussed below. Defector 185 additionally includes a bottom wall 191 having an identical shape as top wall 187. An arcuate end wall 192 interconnects the top, bottom and outer walls to one another.

Each deflector 185 is secured to cylindrical wall 180 by an elongate and vertically oriented hinge 193 which permits inward and outward swinging movement of the deflector 185 through the corresponding opening 183 defined in wall 180. The deflectors 185 are movable into a plurality of positions, with one of these positions being shown in solid lines and another of these positions shown in dotted lines in FIG. 15. The top wall 187 of each deflector 185 defines therein a row of spaced openings 194 along end edge 190. A pair of retaining elements 195 are provided, such as pins, which are inserted into the selected openings 194 on opposite sides of wall 180 to secure the respective deflector 185 in the desired position relative to wall 180.

Figure 16:
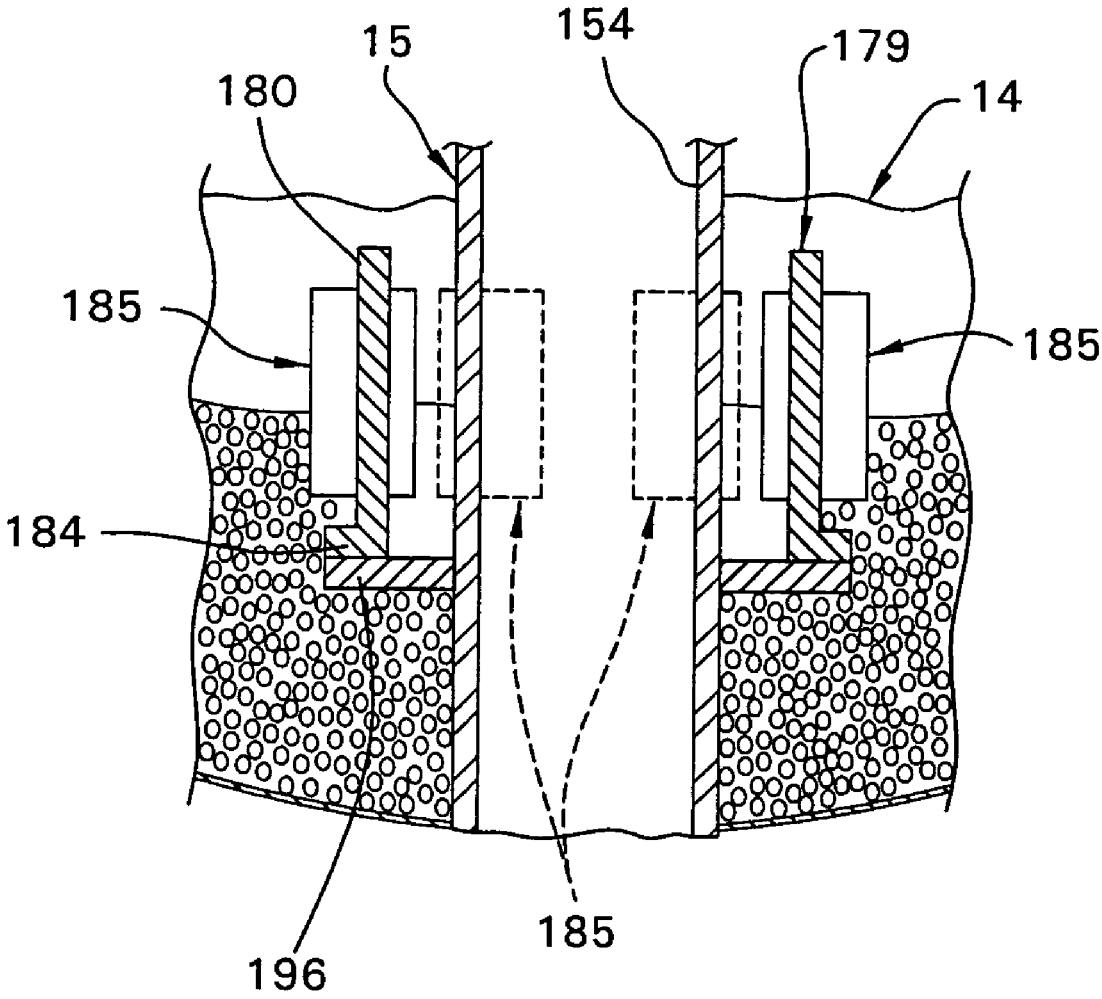
FIG. 16 is a fragmentary cross-sectional view of the hub arrangement illustrated in FIG. 14 incorporated into the wheel polishing device.

With reference to FIG. 16, the hub arrangement 179 may be incorporated into bowl 14, for example by mounting same in surrounding relation with the lower end of central support 15. In this regard, a mounting flange 196 can be fixed to lower end of support 15, and the flange 184 of hub arrangement 179 fixed to this flange 186, for example with fasteners which extend through openings 184A or by welding. The positions of the respective deflectors 185 can be adjusted prior to filling the bowl 14 with media 14A, and fixed in the desired position with retaining elements 195.

Alternatively, as shown in dotted lines in FIG. 16, a series of deflectors 185 can be incorporated directly into the lower end of support 15 about the circumference thereof, for example by providing corresponding openings in the support 15 and hingedly mounting each deflector 185 directly onto the wall 154 of the support 15, so that the deflectors 185 are pivotable inwardly into the hollow interior of the support 15 and outwardly into the interior of the bowl 14.

During processing and due to the orbiting movement of the wheels 12 within the bowl 14, media 14A tends be pushed inwardly causing same to build up at the center of the bowl 14 around the lower end of the support 15. The hub arrangement 179 when utilized with device 10 prevents this build-up of media 14A, since the outwardly projecting deflectors 185 serve to restrict the flow of media so that same is compressed against the wheel 12 or workpiece to improve the finishing thereof. It will be appreciated that the plurality of openings 194 provided on the respective deflectors 185 permit adjustment of the deflectors 185 into multiple positions relative to the vertical axis defined by support 15, which allows adjustment for different sizes of wheels 12 or workpieces.

Although particular preferred embodiments of the invention have been disclosed in detail for illustrative purposes, it will be recognized that variations or modifications of the disclosed apparatus, including the rearrangement of parts, lie within the scope of the present invention.

We claim:

1. A finishing device comprising:

a bowl assembly for positioning on a horizontal support surface such as a floor and including an upwardly opening bowl for storing finishing media therein;

a rotatable carrier plate defining a vertical axis of rotation and supported in vertically upwardly spaced relation from said bowl, said carrier plate including at least one workpiece mounting arrangement projecting downwardly therefrom for positioning the workpiece within the media;

a drive assembly drivingly connected to said carrier plate to rotate same about the vertical axis to cause the workpiece to travel through the finishing media in an orbit defined about the vertical axis; and a hub arrangement disposed generally centrally within an interior of said bowl, said arrangement including at least one deflector element which projects into the interior of said bowl and towards the workpiece to compress the media against the workpiece and prevent build-up of media adjacent the center of the bowl.

2. The finishing device of claim 1 wherein said deflector element is swingably movable towards and away from the workpiece.

3. The finishing device of claim 2 wherein said hub arrangement includes a generally cylindrical wall which mounts thereon a plurality of said deflector elements circumferentially about said wall, each said deflector element being mounted for pivoting movement about a vertical pivot axis relative to said wall and being pivotable into a plurality of positions relative to the workpiece.

4. The finishing device of claim 1 wherein said deflector is mounted for pivoting movement about a vertical axis to permit adjustment of the position of said deflector radially towards and away from the workpiece.

5. The finishing device of claim 1 further including an elongate and vertically oriented support which projects upwardly from a central region of said bowl and supports said drive assembly and said turret thereon, said hub arrangement being disposed adjacent a lower end of said support within an interior of said bowl.

6. A process for finishing a workpiece, said process comprising the steps of:

providing a finishing device including a tank containing finishing media therein, a turret carrying thereon at least one workpiece such that same projects into the tank and is pivotable about a vertical axis, and a drive associated with the turret for rotating same relative to the tank to cause the workpiece to travel along an orbital path within the tank;

positioning the workpiece in contact with the finishing media within the tank;

moving the workpiece along the orbital path and through the finishing media; and oscillating the workpiece about the vertical axis at least once per revolution of the wheel along the orbital path.

7. The process of claim 6 further including vertically oscillating the workpiece relative to the finishing media.

8. A finishing device for a workpiece, such as a wheel, said finishing device comprising:

a bowl assembly including a bowl for storing finishing media therein;

a turret disposed adjacent said bowl and defining an axis of rotation, said turret having secured thereto at least one arm for supporting a wheel thereon and positioning the workpiece in contact with the finishing media; and a drive for rotating the turret and the workpiece carried thereon to cause the workpiece to travel along an orbital path about the axis of rotation through the finishing media within the bowl, said drive including a cam arrangement which varies the angle of the workpiece relative to a tangent of the orbital path at least once per revolution of the workpiece about the axis.

9. The device of claim 8 wherein said bowl assembly includes a generally upright support which is cantilevered upwardly from said bowl and supports thereon said drive and said turret vertically above said bowl.

10. The device of claim 8 wherein said cam arrangement includes a cam plate defining an eccentric track adjacent said turret, and said arm mounting thereon a follower which engages within said track to oscillate the workpiece about a vertical axis during its orbit about the axis of rotation.

11. The device of claim 10 wherein the axis of rotation is vertically oriented, said bowl assembly includes an upright support structure which supports thereon said drive assembly and said turret, said device including a plurality of said arms which are cantilevered downwardly from a lower side of said turret for positioning within the bowl, and said cam plate is mounted in a fixed manner adjacent a lower side of said turret.

12. A finishing device comprising:

a media storage and support assembly having a lower end for positioning on a support surface such as a floor, a tank for storing therein finishing media, and a support element connected to said tank and projecting upwardly from a generally central region thereof;

a rotatable turret positioned above said tank and carried on said support element, said turret including at least one mounting assembly which projects generally downwardly from said turret and supports a workpiece thereon for contact with the finishing media; and a drive assembly carried on said support element in driving engagement with said turret to rotate same about a generally vertically oriented axis and cause the workpiece mounted on said turret to travel in an orbit about the axis.

13. The device of claim 12 wherein said turret is supported on said drive assembly for rotation about said support element relative to said tank.

14. The device of claim 12 wherein said drive assembly includes a sleeve disposed in surrounding relation with said support element, said sleeve mounting thereon a motor which is drivingly connected to said turret by a gear arrangement to rotatably drive said turret about the axis of rotation.

15. The device of claim 14 wherein said turret is supported on said sleeve by a bearing which permits rotation of said turret relative to said sleeve.

16. The device of claim 15 wherein said bearing includes an inner annular portion which is fixed to said sleeve and an outer ring gear which is rotatable relative to said inner portion and forms part of said gear arrangement, said turret being fixed to said ring gear for rotation therewith, said gear arrangement further including a spur gear associated with and driven by said motor, said spur gear being drivingly engaged with said ring gear for driving said turret.

17. The device of claim 12 wherein said drive assembly is a first drive assembly, and said device includes a second drive assembly in driving engagement with said turret to vertically raise or lower said turret and said mounting assembly relative to said tank.

* * * * *